US006987416B2

(12) United States Patent
Ker et al.

(10) Patent No.: US 6,987,416 B2
(45) Date of Patent: Jan. 17, 2006

(54) LOW-VOLTAGE CURVATURE-COMPENSATED BANDGAP REFERENCE

(75) Inventors: Ming-Dou Ker, Hsin-Chu (TW); Ching-Yun Chu, Hsin-Chu (TW); Wen-Yu Lo, Tai-Chung Hsien (TW)

(73) Assignee: Silicon Integrated Systems Corp., Hsin-Chu (TW)

( * ) Notice: Subject to any disclaimer, the term of this patent is extended or adjusted under 35 U.S.C. 154(b) by 163 days.

(21) Appl. No.: 10/708,222

(22) Filed: Feb. 17, 2004

(65) Prior Publication Data

US 2005/0264345 A1 Dec. 1, 2005

(51) Int. Cl.
*G05F 1/10* (2006.01)

(52) U.S. Cl. ..... 327/539; 327/513

(58) Field of Classification Search ..... 323/313, 323/314; 327/513, 530, 534, 535, 537, 538, 327/539, 540, 541, 543
See application file for complete search history.

(56) References Cited

U.S. PATENT DOCUMENTS

| | | | | |
|---|---|---|---|---|
| 5,034,626 | A * | 7/1991 | Pirez et al. | 327/542 |
| 5,604,427 | A * | 2/1997 | Kimura | 323/313 |
| 5,818,294 | A * | 10/1998 | Ashmore, Jr. | 327/543 |
| 6,107,868 | A * | 8/2000 | Diniz et al. | 327/543 |
| 6,522,117 | B1 * | 2/2003 | Young et al. | 323/315 |
| 6,563,295 | B2 * | 5/2003 | Juang | 323/315 |

OTHER PUBLICATIONS

H. Neuteboom, B.M. J. Kup, M. Janssens; A DSP-based hearing instrument IC; IEEE Journal of Solid-State Circuits, Nov. 1997; p. 1790-p. 1806; vol. 32.

H. Banba, H. Shiga, A. Umezawa, T. Miyaba, T. Tanzawa, S. Atsumi, K. Sakui; A CMOS bandgap reference circuit with sub1-V operation; IEEE Journal of Solid-State Circuits; May 1999; p. 670-p. 674; vol. 34.

G. Giustolisi; A Low-Voltage Low-Power Voltage Reference Based on Subthreshold MOSFETs; IEEE Journal of Solid-State Circuits; Jan. 2003, p. 151-p. 154; vol. 38, No. 1.

P. Malcovati, F. Maloberti, M. Pruzzi, C. Fiocchi; Curvature compensated BiCMOS bandgap with 1-V supply voltage; IEEE Journal of Solid-State Circuits; Jul. 2001; p. 52-p. 55; vol. 36, No. 7.

Yueming Jiang, Edward K.F. Lee; A 1.2 V bandgap reference based on transimpedance amplifier; ISCAS 2000-IEEE international symposium on Circuits and Systems; May 23-31, 2000; p. 261-p. 264.

Shu-Yuan Chin, Chung-Yu Wu, A New Type of Curvature-Compensated CMOS Bandgap Voltage Reference; VLSITSA; 1991; p. 398-p. 402.

Ka Nang Leung, IEEE, Philip K. T. Mok; A Sub-1-V 15-ppm/-C CMOS Bandgap Voltage Reference without Requiring Low Threshold Voltage Device; IEEE Journal of Solid-State Circuits; Apr. 2002: p. 526-p. 530: vol. 37, No. 4.

S.M.Sze; Physics of Semiconductor Devices; John Wiley & Sons. Inc.; 1985; p. 28-29; 2en ed.

* cited by examiner

*Primary Examiner*—Jeffrey Zweizig
(74) *Attorney, Agent, or Firm*—Winston Hsu

(57) ABSTRACT

A subtractor is connected between a p-channel bandgap reference unit and an n-channel bandgap reference unit. The subtractor includes two NPN transistors connected to the p-channel bandgap reference unit, and two PNP transistors connected to the n-channel bandgap reference unit. The subtractor takes the difference of the two currents produced by the p-channel and n-channel bandgap reference units and generates a temperature insensitive and curvature-compensated reference voltage of less than one volt across an output resistor.

17 Claims, 13 Drawing Sheets

LOW-VOLTAGE CURVATURE-COMPENSATED BANDGAP REFERENCE

BACKGROUND OF INVENTION

1. Field of the Invention

The present invention relates to a voltage reference circuit with low sensitivity to temperature, and more specifically, to a low-voltage bandgap reference circuit.

2. Description of the Prior Art

Reference voltage generators are widely used in both analog and digital circuits such as DRAM and flash memories. A bandgap reference (also termed BGR) is a circuit that provides a stable output voltage with low sensitivity to temperature and supply voltage.

A conventional bandgap reference output is about 1.25 V, which is almost equal to the silicon energy gap measured in electron volts. However, in modern deep-submicron technology, a voltage of around 1 V is preferred. As such, the conventional bandgap reference is inadequate for current requirements.

The 1 V minimum supply voltage is constrained by two factors. First, the reference voltage of about 1.25 V exceeds 1 V. Second, low voltage design of proportional to-absolute-temperature (PTAT) current generation loops is limited by the input common-mode voltage of the amplifier. The effects of these constraints can be reduced by resistive subdivision methods and by using low threshold voltage devices or BiCMOS processes. However, both of these solutions require costly special process technology.

Bandgap references can be divided into two groups: type-A and type-B. Type-A bandgap references sum voltages of two elements having opposite temperature components. Type-B bandgap references combine the currents of two elements. Both type A and type B bandgap references can be designed to function with a normal supply voltage of greater than 1 V and a sub-1-V supply voltage.

FIG. 1 illustrates a conventional type-A bandgap reference circuit 10. The bandgap reference circuit 10 includes an operational amplifier 12, two transistors M1 and M2, two resistors R1 and R2, and two diodes Q1 and Q2. The sources of the transistors M1, M2 are connected to a supply voltage $V_{DD}$. The drain of the transistor M1 is connected to the emitter of the diode Q1 through the resistor R1 and to the positive input of the amplifier 12. Similarly, the drain of the transistor M2 is connected to the emitter of the diode Q2 through the resistor R2 and to the negative input of the amplifier 12. The gates of the transistors M1, M2 are connected to the output of the amplifier 12. In CMOS applications, each diode Q1, Q2 is formed with a parasitic vertical bipolar transistor having a collector and base connected to ground.

Neglecting base current, the emitter-base voltage of a forward active operation diode can be expressed as:

$$V_{EB} = \frac{kT}{q}\ln\left(\frac{I_C}{I_S}\right) \tag{1}$$

where:

k is Boltzmanns constant ($1.38\times10^{-23}$ J/K), q is the electronic charge ($1.6\times10^{-19}$ C), T is temperature, $I_C$ is the collector current, and $I_S$ is the saturation current.

When the input voltages of the amplifier 12 are forced to be the same, and the size of the diode Q1 is N times that of the diode Q2, the emitter-base voltage difference between diodes Q1 and Q2, $\Delta V_{EB}$, becomes:

$$\Delta V_{EB} = V_{EB2} - V_{EB1} = \frac{kT}{q}\ln N \tag{2}$$

where:

$V_{EB1}$ is the emitter-base voltage of diode Q1, and $V_{EB2}$ is the emitter-base voltage of diode Q2.

Finally, when the current through resistor R1 is equal to the current through resistor R2 and is set to be PTAT, an output reference voltage, $V_{REF}$, can be obtained by:

$$V_{REF} = V_{EB2} + \frac{R_2}{R_1}\Delta V_{EB} \equiv V_{REF\text{-}CONV} \tag{3}$$

where:

$R_1$ is the resistance of resistor R1, $R_2$ is the resistance of resistor R2, and $V_{REF\text{-}CONV}$ is the reference voltage (conventional).

The emitter-base voltage, $V_{EB}$, has a negative temperature coefficient of −2 mV/° C., while the emitter-base voltage difference, $\Delta V_{EB}$, has a positive temperature coefficient of 0.085 mV/° C. Hence, if a proper ratio of resistances of resistors R1 and R2 is selected, the output reference voltage, $V_{REF}$, will have low sensitivity to temperature. In general, the supply voltage, $V_{DD}$, is set to about 3–5 V and the output reference voltage, $V_{REF}$, is about 1.25 V, as the conventional bandgap circuit 10 cannot be used at a lower voltage such as 1 V.

FIG. 2 illustrates a conventional type-B bandgap reference circuit 20. Elements in FIG. 2 having the same reference numbers of those in FIG. 1 are the same. The bandgap reference circuit 20 includes an operational amplifier 22; three transistors M1, M2, and M3; four resistors R1, R2, R3, and R4; and two diodes Q1 and Q2 interconnected as illustrated in FIG. 2.

Compared with the type-A circuit 10, the type-B circuit 20 is more suitable for operating with a low supply voltage. Instead of stacking two complementary voltages, the type-B bandgap reference 20 adds two currents with opposite temperature dependencies. In the bandgap reference of FIG. 2, the current through the resistor R3 is PTAT. If the resistances of the resistors R1 and R2 are equal, then the current through the MOS transistor M3 mirrored from transistors M1 and M2 can be expressed as:

$$I_{M3} = \frac{1}{R_1}\left(V_{EB2} + \frac{R_1}{R_3}\frac{kT}{q}\ln N\right) \tag{4}$$

with the reference voltage being expressed as:

$$V_{REF} = \frac{R_4}{R_1}\left(V_{EB2} + \frac{R_1}{R_3}\frac{kT}{q}\ln N\right) = \frac{R_4}{R_1}\cdot V_{REF\text{-}CONV} \tag{5}$$

Thus, in the bandgap reference circuit 20 of FIG. 2, as ratios of resistances are key, the variations in individual resistances due to process conditions does not greatly affect the reference voltage. In general, the supply voltage, $V_{DD}$, is set to about 1.5 V and the output reference voltage, $V_{REF}$, is about 1.2 V.

FIG. 3 illustrates a conventional type-B bandgap reference circuit 30 capable of sub-1-V operation. Elements in FIG. 3 having the same reference numbers of those in FIG. 2 are the same. The bandgap reference circuit 30 includes an operational amplifier 32; three transistors M1, M2, and M3; six resistors R1*a*, R1*b*, R2*a*, R2*b*, R3, and R4; and two diodes Q1 and Q2 interconnected as illustrated in FIG. 3. The supply voltage is limited by the input common-mode voltage of the amplifier 32, which must be low enough to ensure that the input pair operate in the saturation region.

The improvement of low supply voltage realized with the bandgap reference circuit 30 is based on the positions of the input pair of the operational amplifier 32. The established feedback loop produces a PTAT voltage across the resistor R3. The resistance ratio of the resistors R1*a* and R2*a* causes the voltage between the supply voltage and the input common voltage of the operational amplifier 32 to become increased. This makes the p-channel input pair operate in the saturation region even when the supply voltage is under 1V. The sub-1-V reference voltage output by the circuit 30 can be expressed as:

$$V_{REF\text{-}SUB1F} = \frac{R_4}{R_1}\left(V_{EB2} + \frac{R_1}{R_3}\frac{kT}{q}\ln N\right) = \frac{R_4}{R_1}\cdot V_{REF\text{-}CONV} \tag{6}$$

which is similar to the circuit 20 of FIG. 2. During operation of the circuit 30, the supply voltage, $V_{DD}$, is set to about 1.0–1.9 V and the output reference voltage, $V_{REF}$, is about 0.6 V.

Given the state-of-the-art bandgap reference circuits 10, 20, and 30 described above, it is clear that an improved and inexpensive low-voltage bandgap reference circuit is required.

SUMMARY OF INVENTION

It is therefore a primary objective of the claimed invention to provide a low-voltage curvature-compensated bandgap reference circuit having low sensitively to temperature.

Briefly summarized, the claimed invention includes a first bandgap reference unit having an output connected to a first node, a second bandgap reference unit having an output connected to a second node, and a subtractor connecting the first and second bandgap reference units at the first and second nodes. The subtractor comprises a first transistor having a source connected to a first voltage, and a drain and a gate both connected to the second node; a second transistor having a source connected to the first voltage, a drain connected to a third node, and a gate connected to the gate of the first transistor; a third transistor having a source connected to a second voltage, and a drain and a gate both connected to the first node; a fourth transistor having a source connected to the second voltage, a drain connected to the third node, and a gate connected to the gate of the third transistor; and an output resistor connected between the third node and to the second voltage.

It is an advantage of the claimed invention that a temperature insensitive reference voltage of less than 1 volt can be obtained at the third node when the first and second voltages are set appropriately.

It is a further advantage of the claimed invention that the bandgap reference circuit is compatible with established CMOS technology.

It is a further advantage of the claimed invention that no low-threshold voltage or BiCMOS devices are required.

These and other objectives of the claimed invention will no doubt become obvious to those of ordinary skill in the art after reading the following detailed description of the preferred embodiment that is illustrated in the various figures and drawings.

DETAILED DESCRIPTION

Figure 4:
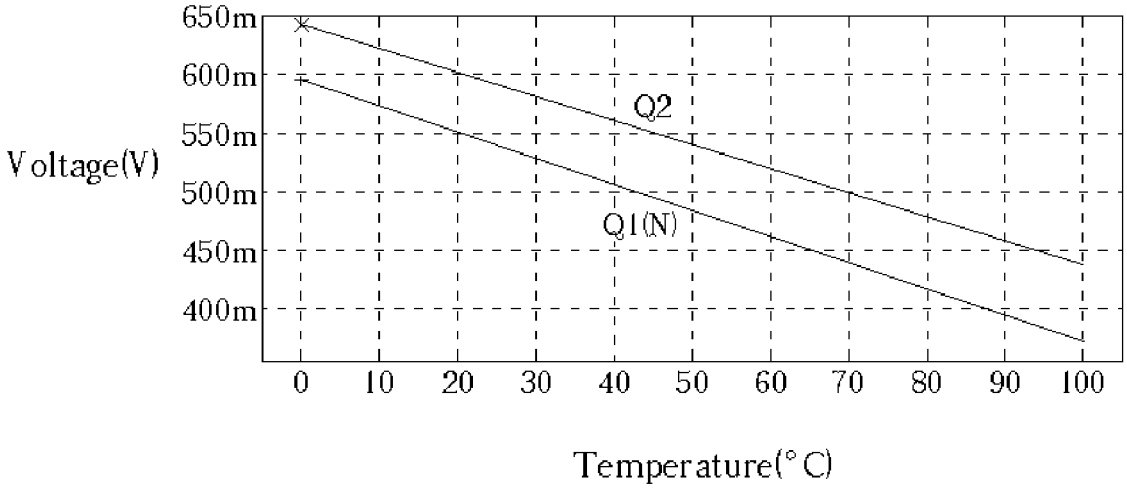
FIG. 4 is a graph of base-emitter voltage versus temperature of two diodes of a bandgap reference.
Figure 5:
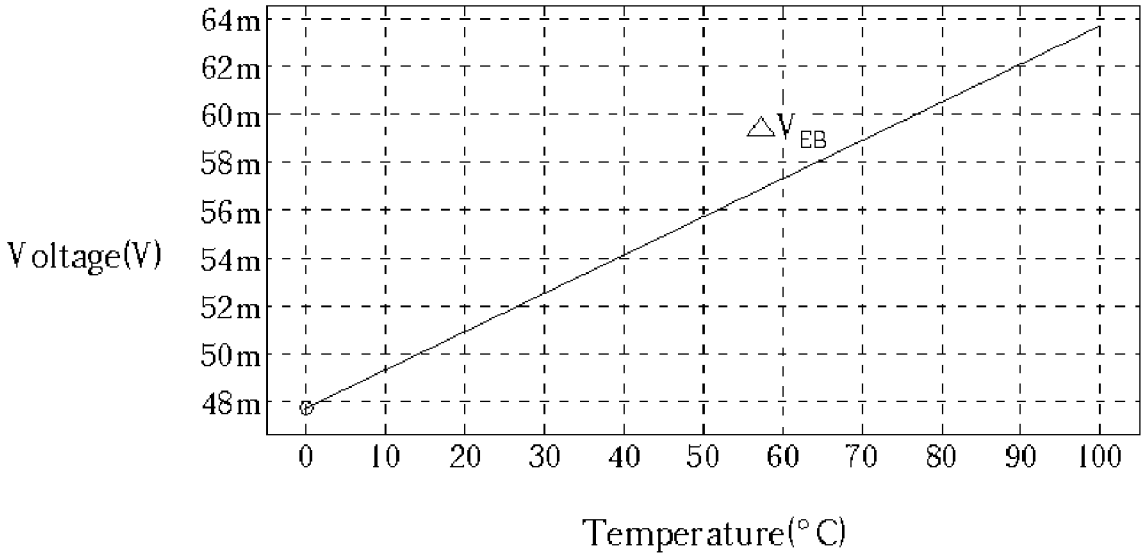
FIG. 5 is a graph of the difference of the diode base-emitter voltages of FIG. 4 versus temperature.

As a basis for the explaining the present invention, please refer to FIG. 4 and FIG. 5. FIG. 4 illustrates base-emitter voltage of two diodes Q1, Q2 (discussed later) with respect to temperature. FIG. 5 illustrates the difference of the diode base-emitter voltages with respect to temperature. It can be seen that the base-emitter voltage, $V_{EB}$, has a negative temperature coefficient of about −2 mV/° C. with $V_{EB}$=0.55 V and T=300 K. The difference of the diode base-emitter voltages, $\Delta V_{EB}$, with respect to temperature, as shown in FIG. 5, is used in the present invention to produce a PTAT to eliminate the effect of the negative temperature coefficient.

As a further basis, consider that the output reference voltage, $V_{REF}$, of a conventional bandgap circuit is given by:

$$V_{REF} = E_G + V_T(\gamma - \alpha)\left(1 + \ln\frac{T_0}{T}\right) \tag{7}$$

where:

$\gamma$ is from $$\bar{\mu}=CT^{\gamma-4}$$

defining the average hole mobility in the base, $\alpha$ is from $$I_C=GT^{\alpha}$$

$E_G$ is the bandgap voltage of silicon, $T_0$ is the temperature in Kelvin where the temperature coefficient of $V_{REF}$ is zero, and $T_0$ is temperature in Kelvin.

Neglecting the temperature dependence of the bandgap voltage of silicon, $E_G$, and differentiating (7) once and twice with respect to temperature yields:

$$\frac{\partial V_{REF}}{\partial T}=\frac{k}{q}(\gamma-\alpha)\ln\frac{T_0}{T} \tag{8}$$

and $$\frac{\partial}{\partial T}\left(\frac{\partial V_{REF}}{\partial T}\right)=-\frac{k}{q}\frac{(\gamma-\alpha)}{T} \tag{9}$$

It should be noted that the term $(\gamma-\alpha)$ in (9) controls the curvature of the $V_{REF}$ curve of (7). So that if the term $(\gamma-\alpha)$ is positive then $V_{REF}$ is concave down everywhere, and if the term $(\gamma-\alpha)$ is negative then $V_{REF}$ is concave up everywhere.

Figure 6:
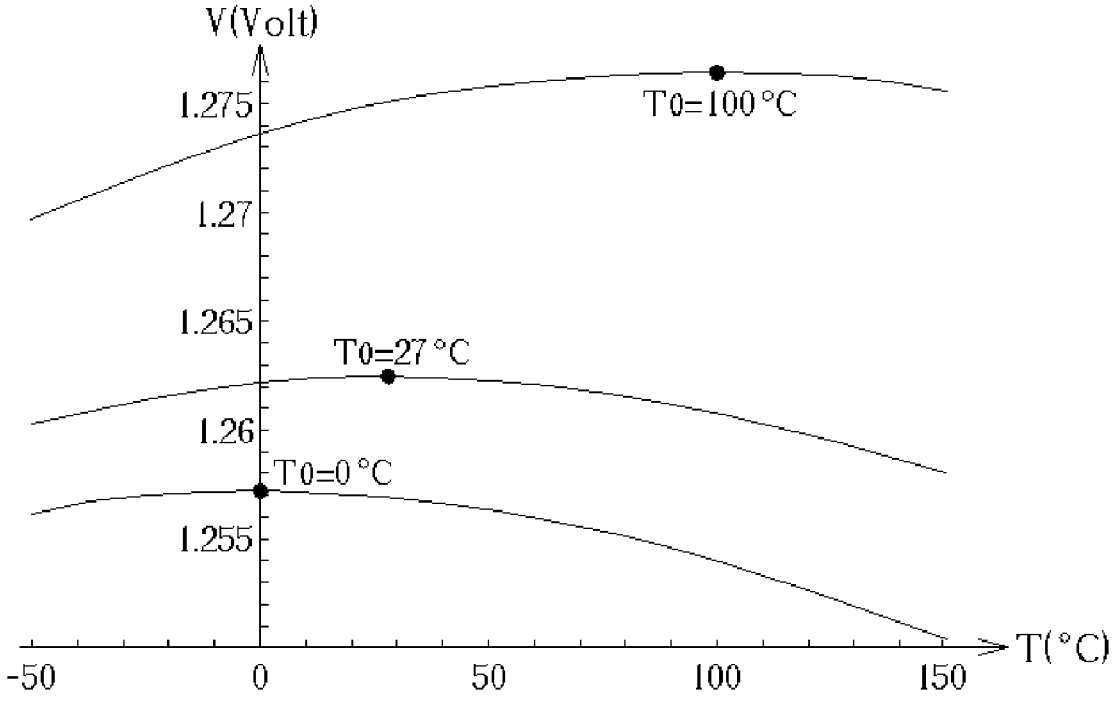
FIG. 6 is a graph of a family of output reference voltage curves.

Referring to FIG. 6, illustrating a family of concave up output reference voltage curves according to (7). FIG. 6 shows several curves of different zero-reference-temperatures $T_0$ according to a simulation specifying a bandgap circuit with PNP bipolar transistors of a TSMC 0.25 $\mu$m 1P5M process, pure p-type silicon near room temperature, and $\gamma$=1.8 and $\alpha$=0.

Figure 7:
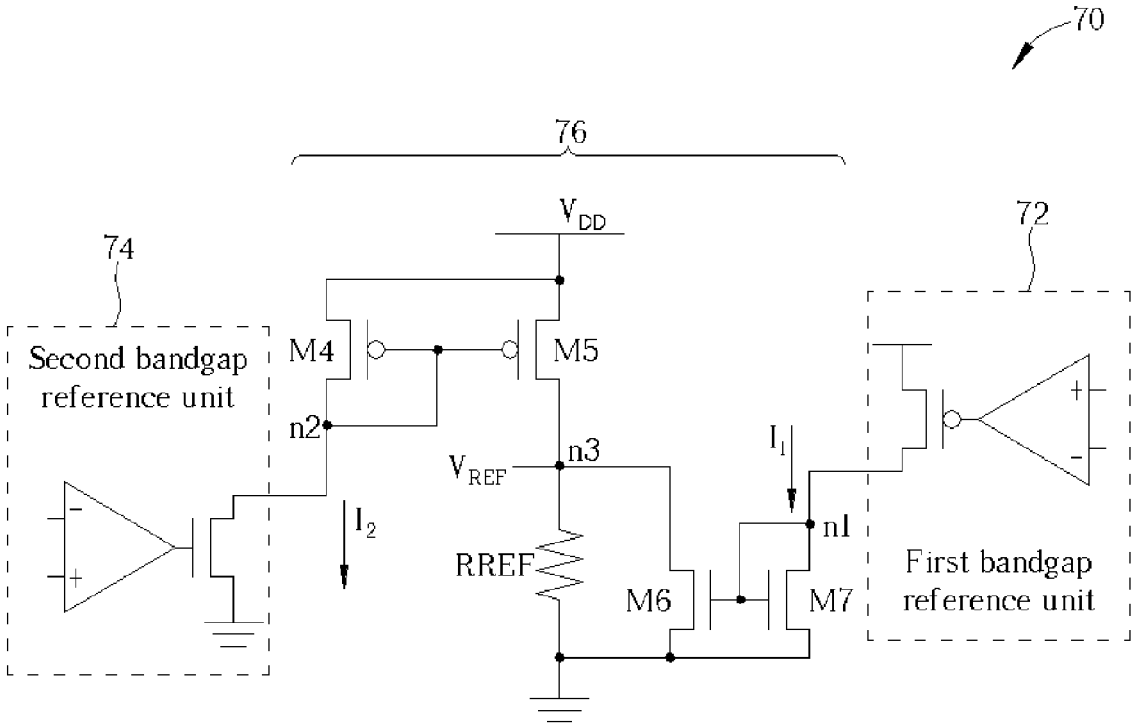
FIG. 7 is a circuit diagram of a low-voltage curvature-compensated bandgap reference circuit according to a first embodiment.

Please refer to FIG. 7 illustrating a low-voltage curvature-compensated bandgap reference circuit 70 according to a first embodiment of the present invention. The bandgap reference circuit 70 is a CMOS circuit, however other implementations are certainly possible. The circuit 70 includes a first bandgap reference unit 72 having an output connected to a first node n1, a second bandgap reference unit 74 having an output connected to a second node n2, and a subtractor 76 connected between the bandgap reference 72, 74. The first bandgap reference unit 72 is a p-channel device that outputs a current $I_1$, and the second bandgap reference unit 74 is an n-channel device that outputs a current $I_2$.

The subtractor 76 includes a first transistor M4 having a source connected to a first voltage $V_{DD}$ and a drain and gate both connected to the second node n2, and a second transistor M5 having a source also connected to the first voltage $V_{DD}$, a drain connected to a third node n3, and a gate connected to the gate of the first transistor M4. The transistors M4 and M5 and PNP devices. The subtractor 76 further comprises a third transistor M6 having a source connected to ground and a drain and gate both connected to the first node n1, and a fourth transistor M7 having a source connected to ground, a drain connected to the third node n3, and a gate connected to the gate of the third transistor M6. The transistors M6 and M7 are NPN devices. An output resistor RREF is connected between the third node n3 and ground.

Figure 8:
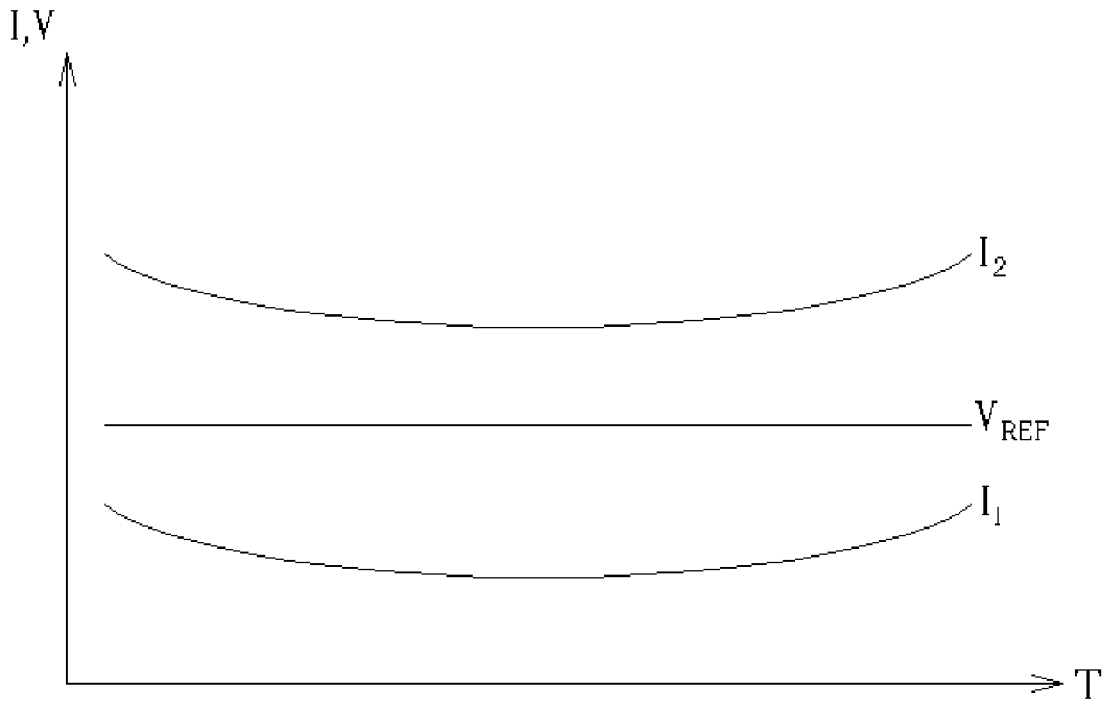
FIG. 8 is a graph of the currents and a reference voltage of the circuit of FIG. 7.
Figure 9:
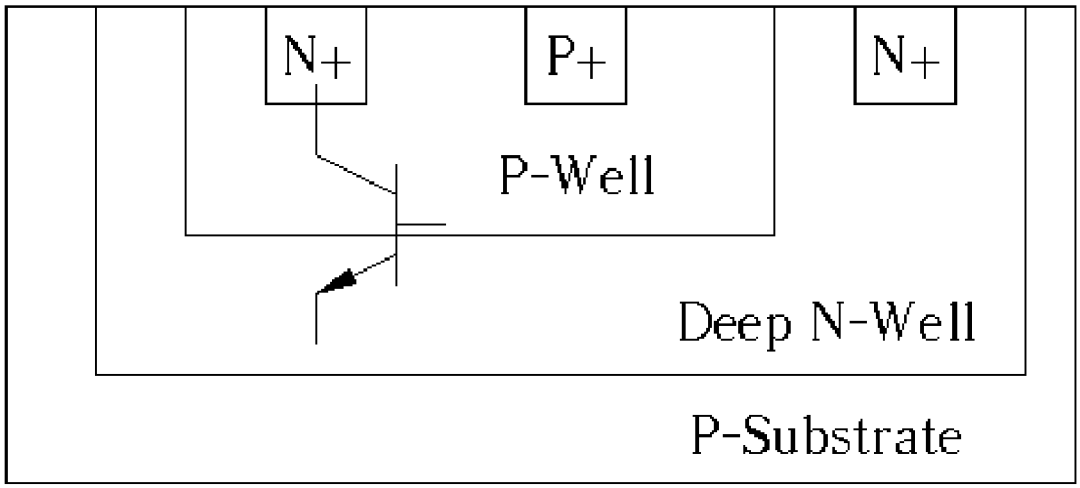
FIG. 9 is a schematic diagram of a parasitic vertical NPN CMOS BJT.

Please refer to FIG. 8 illustrating the currents and reference voltage of the circuit 70 of FIG. 7. The currents $I_1$ and $I_2$ are both concave up and both have similar curvature when the first and second reference units 72, 74 are designed to have close values of $T_0$. As can be seen in FIG. 8, a fundamental operation of the subtractor 76 is to subtract the smaller current $I_1$ generated by the first bandgap reference 72 from the larger current $I_2$ generated by the second bandgap reference 74. The result of this operation is a temperature insensitive and curvature-compensated voltage $V_{REF}$ across the resistor RREF. In addition, FIG. 9 illustrates a schematic diagram of a parasitic vertical NPN bipolar junction transistor (BJT) made with standard CMOS processes with a deep n-well, which is one kind of device that can be used to realize the present invention.

Figure 10:
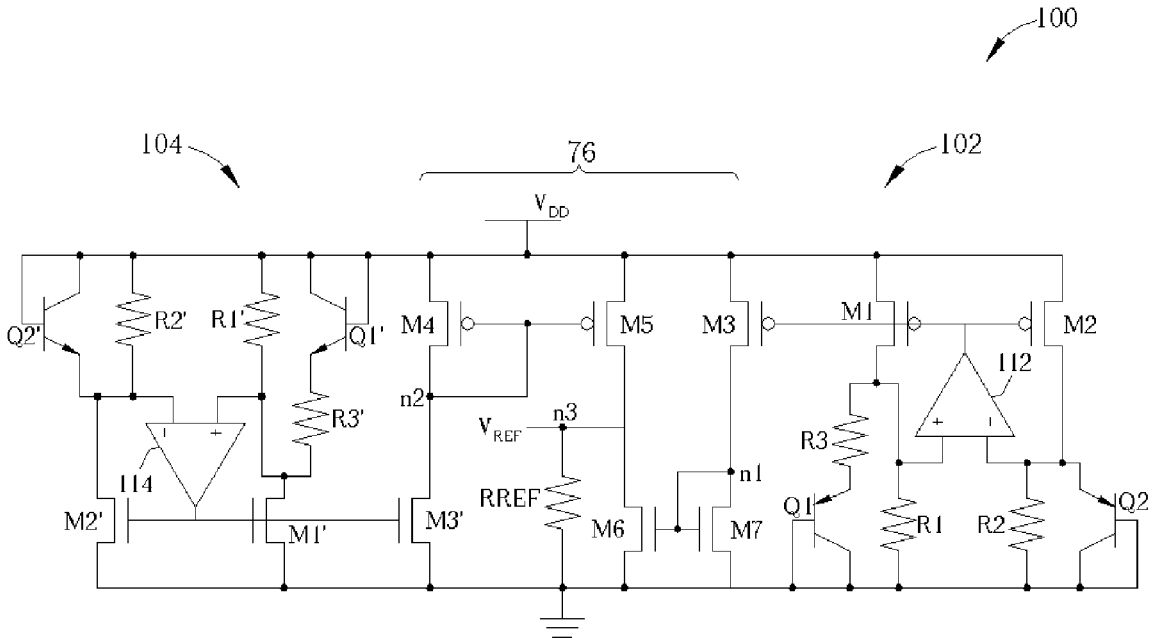
FIG. 10 is a circuit diagram of a low-voltage curvature-compensated bandgap reference circuit according to a second embodiment.

Please refer to FIG. 10 illustrating a circuit diagram of a low-voltage curvature-compensated bandgap reference circuit 100 according to a second embodiment of the present invention. The circuit 100 includes a p-channel bandgap reference unit 102 (similar to the unit 72) and an n-channel bandgap reference unit 104 (similar to the unit 74) mutually connected by the subtractor 76. The circuit 100 can be considered as a more specific embodiment of the circuit 70, and consequently the previous description of the circuit 70 also applies to the circuit 100.

Figure 1:
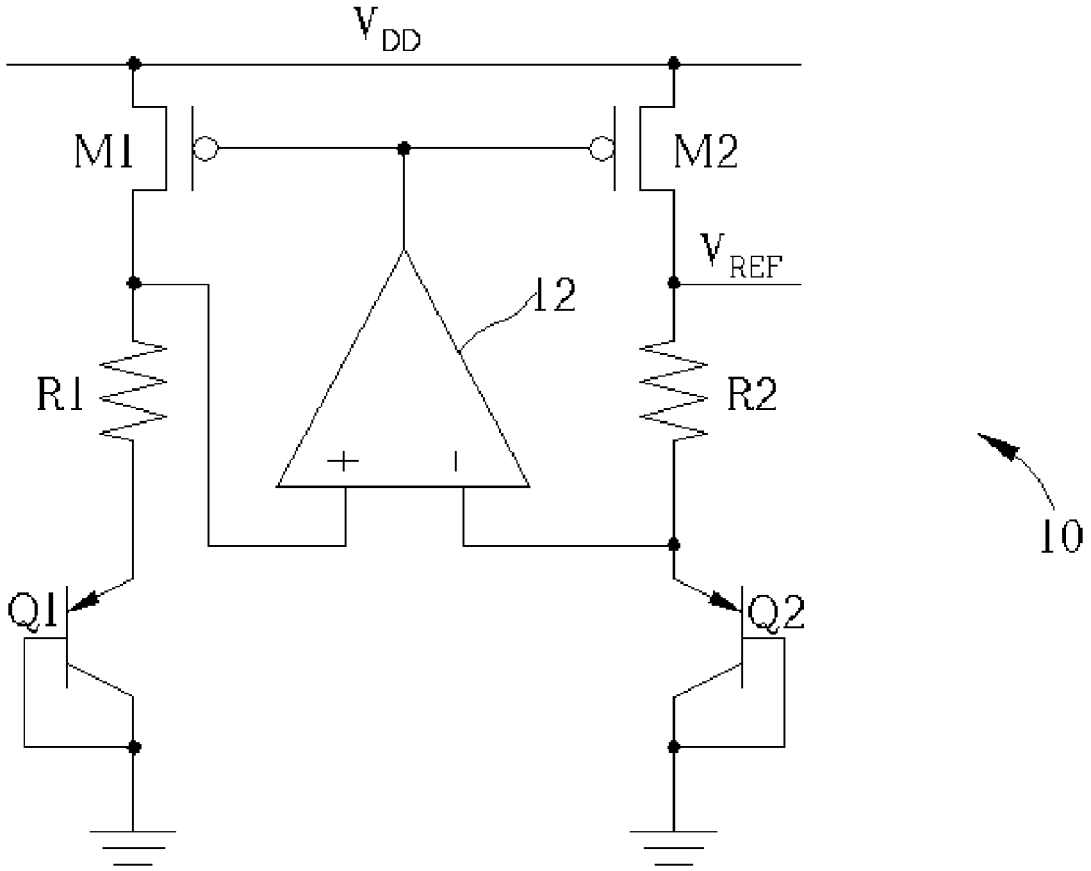
Fig. 1 Prior art
FIG. 1 is a circuit diagram of a conventional bandgap reference.
Figure 2:
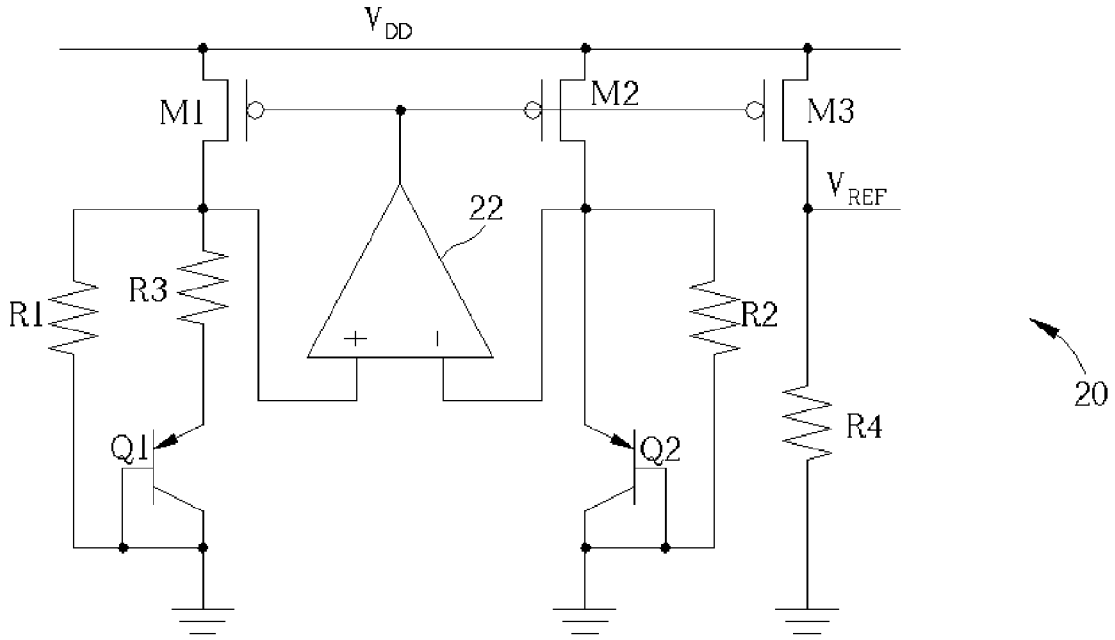
Fig. 2 Prior art
FIG. 2 is a circuit diagram of a conventional low-voltage bandgap reference.

The p-channel bandgap reference unit 102 is similar to the bandgap reference circuit 20 of FIG. 2, and as such, components with same reference numerals are the same. The p-channel bandgap reference unit 102 includes a first operational amplifier 112; a fifth transistor M1 having a source connected to the first voltage $V_{DD}$, a drain connected to the positive input end of the amplifier 112, and a gate connected to the output end of the amplifier 112; and a sixth transistor M2 having a source connected to the first voltage $V_{DD}$, a drain connected to the negative input end of the amplifier 112, and a gate connected to the output end of the amplifier 112. The circuit 102 further comprises a first resistor R1 connected between ground and the positive input end of the amplifier 112, a second resistor R2 connected between ground and the negative input end of the amplifier 112, a first diode Q1 having a collector and base connected to ground and an emitter connected to the positive input end of the amplifier 112 through a third resistor R3, and a second diode Q2 having a collector and base connected to ground and an emitter connected to the positive input end of the amplifier 112. Finally, the circuit 102 comprises a seventh transistor M3 having a source connected to the first voltage $V_{DD}$, a gate connected to the output end of the amplifier 112, and a drain connected to the first node n1. The transistors M1, M2, M3 and the diodes Q1, Q2 are PNP.

The n-channel bandgap reference unit 104 is similar to an n-channel version of the bandgap reference circuit 20 of FIG. 2. The n-channel bandgap reference unit 104 includes a second operational amplifier 114; an eighth transistor M1 having a source connected to ground, a drain connected to the positive input end of the operational amplifier 114, and a gate connected to the output end of the operational amplifier 114; and a ninth transistor M2 having a source connected to ground, a drain connected to the negative input end of the amplifier 114, and a gate connected to the output end of the amplifier 114. The circuit 104 further comprises a fourth resistor R1 connected between the first voltage $V_{DD}$ and the positive input end of the amplifier 114, a fifth resistor R2 connected between the first voltage $V_{DD}$ and the negative input end of the amplifier 114, a third diode Q1 having a collector and base connected to the first voltage $V_{DD}$ and an emitter connected to the positive input end of the amplifier 114 through a sixth resistor R3, and a fourth diode Q2 having a collector and base connected to the first voltage $V_{DD}$, and an emitter connected to the positive input end of the amplifier 114. Finally, the circuit 104 comprises a tenth transistor M3 having a source connected to ground, a gate connected to the output end of the amplifier 114, and a drain connected to the second node n2. The transistors M1, M2, M3 and the diodes Q1, Q2 are NPN.

From (4), the current produced by the p-channel bandgap reference unit 102 at the node n1 is given by:

$$I_1 = \frac{1}{R_1}\left(V_{EB2} + \frac{R_1}{R_3}\frac{kT}{q}\ln N_{PNP}\right) = \frac{V_{\text{REF_PNP}}}{R_1} \tag{10}$$

where:

$R_1$ is the resistance of the resistor R1, $R_3$ is the resistance of the resistor R3, $V_{EB2}$ is the emitter-base voltage of diode Q2, $N_{PNP}$ is the ratio of the sizes of diodes Q1 and Q2, and $V_{REF_PNP}$ is the voltage at the first node n1.

Similarly, the current produced by the n-channel bandgap reference unit 104 at the node n2 can be expressed as:

$$I_2 = \frac{1}{R_1'}\left(V_{BE2} + \frac{R_1'}{R_3'}\frac{kT}{q}\ln N_{NPN}\right) = \frac{V_{\text{REF_NPN}}}{R_1'} \tag{11}$$

where:

$R_1$ is the resistance of the resistor R1, $R_3$ is the resistance of the resistor R3, $V_{BE2}$ is the base-emitter voltage of the diode Q2, $N_{NPN}$ is the ratio of the sizes of diodes Q1 and Q2, and $V_{REF_NPN}$ is the voltage at the second node n2.

Then, applied with (7) the difference current $\Delta I = I_2 - I_1$ is:

$$\Delta I = E_G\left(\frac{1}{R_1'} - \frac{1}{R_1}\right) + V_T\left(1 + \ln\frac{T_0}{T}\right)\left(\frac{(\gamma-\alpha)_{NPN}}{R_1'} - \frac{(\gamma-\alpha)_{PNP}}{R_1}\right) \tag{12}$$

where:

$\gamma$ for NPN circuit 104 is 1.58 for silicon at room temperature, and $\gamma$ for PNP circuit 102 is 1.8 for silicon at room temperature.

When suitable resistance values for the resistors R1 and R1 are selected, the latter term in (12) can be eliminated. Neglecting the temperature dependence of $E_G$, $\Delta I$ becomes a temperature independent current. Therefore, a temperature independent current is achieved across the resistor RREF, and the corresponding output reference voltage can be expressed as:

$$V_{REF} = R_{REF}(I_2 - I_1) = \frac{R_{REF}}{R_1}\left((V_{BE2} - V_{EB2}) + \left(\frac{1}{R_3'} - \frac{1}{R_3}\right)R_1\frac{kT}{q}\ln N\right) \tag{13}$$

where:

$R_{REF}$ is the resistance of the resistor RREF, and $R_1 = R_1$ and $N_{NPN} = N_{PNP}$.

By tuning the resistors, close values of $T_0$ for the bandgap units 102, 104 can be obtained easily. Thus, the bandgap units 102, 104 produce two currents ($I_1$ and $I_2$ respectively) of different magnitudes but similar $T_0$, such that the subtractor 76 can produce the temperature insensitive voltage $V_{REF}$ at node n3.

For the second embodiment bandgap reference circuit 100, the minimum supply voltage, $V_{DD(min)}$, is given by:

$$V_{DD(min)} = \text{Max}\lfloor(V_{EB2_PNP} + |V_{TP}| + 2\cdot|V_{DSsat}|), (V_{BE2_NPN} + V_{TN} + 2V_{DSsat})\rfloor \tag{14}$$

where:

$V_{EB2_PNP}$ is the emitter-base voltage of the diode Q2, $V_{BE2_NPN}$ is the base-emitter voltage of the diode Q2, $V_{TP}$ is the PNP threshold voltage, $V_{TN}$ is the NPN threshold voltage, and $V_{DSSat}$ is the drain-source saturation voltage.

Figure 11:
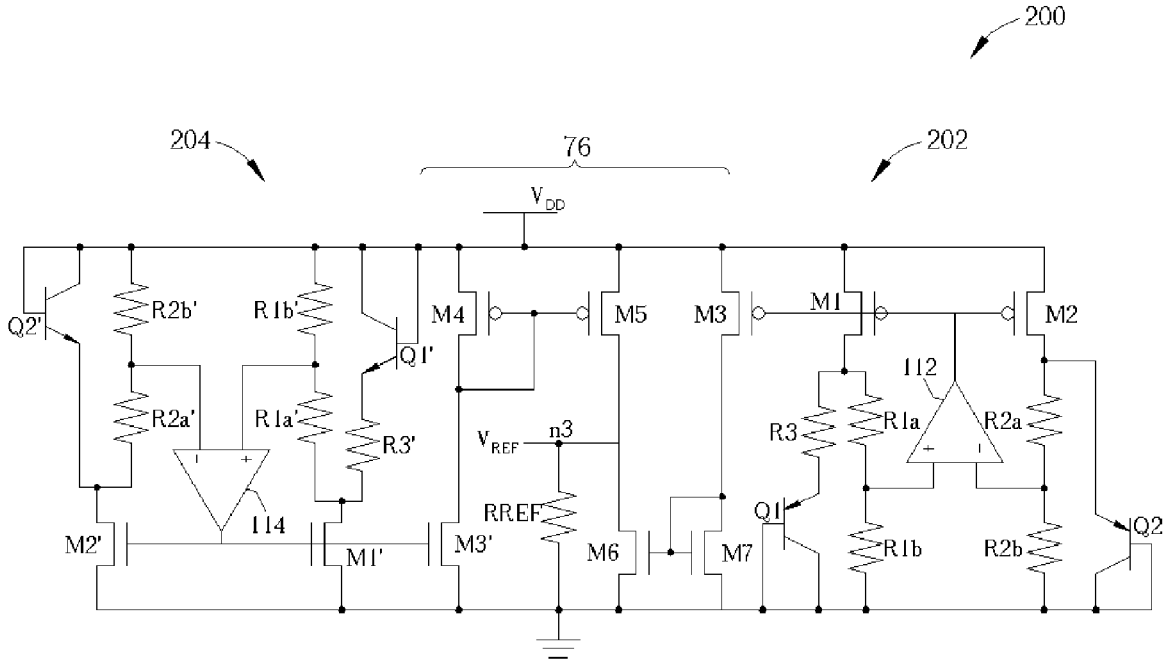
FIG. 11 is a circuit diagram of a low-voltage curvature-compensated bandgap reference circuit according to a third embodiment.

Please refer to FIG. 11 illustrating a circuit diagram of a low-voltage curvature-compensated bandgap reference circuit 200 according to a third embodiment of the present invention. The circuit 200 includes a p-channel bandgap reference unit 202 (similar to the units 72, 102) and an n-channel bandgap reference unit 204 (similar to the units 74, 104) mutually connected by the subtractor 76. The circuit 200 can be considered as a more specific embodiment of the circuit 70, and consequently the previous description of the circuit 70 also applies to the circuit 200.

Figure 3:
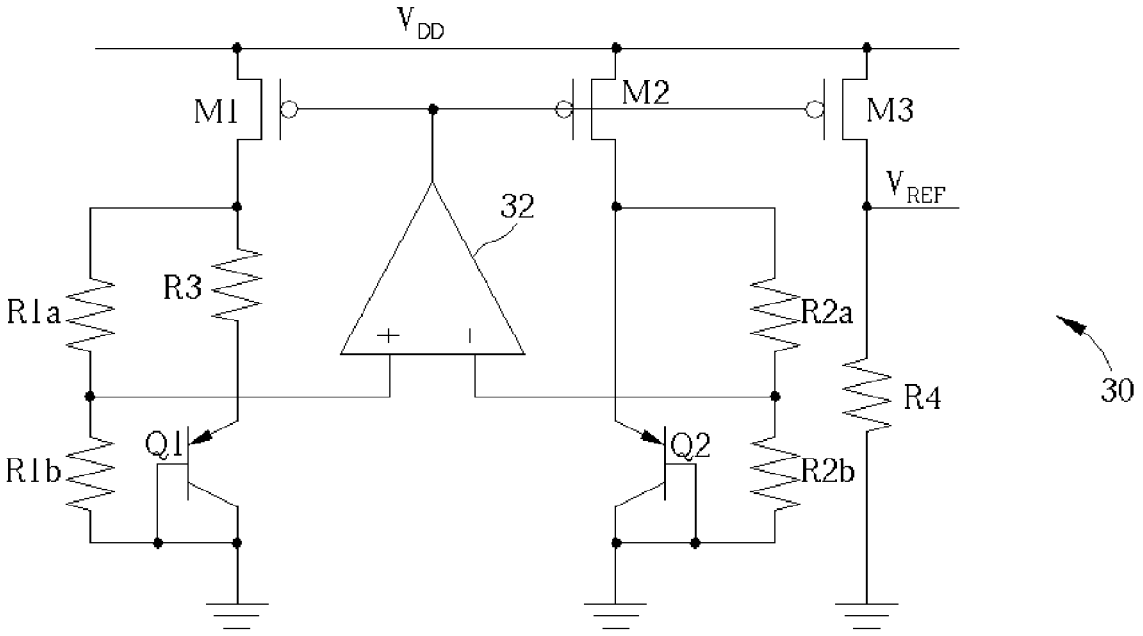
Fig. 3 Prior art
FIG. 3 is a circuit diagram of a conventional low-voltage bandgap reference.

The p-channel bandgap reference unit 202 is similar to the bandgap reference circuit 30 of FIG. 3, and as such, components with same reference numerals are the same. The p-channel bandgap reference unit 202 includes the operational amplifier 112; the transistor M1 having the source connected to the voltage $V_{DD}$, the drain connected to the positive input end of the amplifier 112 through a seventh resistor R1*a*, and the gate connected to the output end of the amplifier 112; and the transistor M2 having the source connected to the voltage $V_{DD}$, the drain connected to the negative input end of the amplifier 112 through an eighth resistor R2*a*, and the gate connected to the output end of the amplifier 112. The circuit 202 further comprises a ninth resistor R1*b* connected between ground and the positive input end of the amplifier 112, a tenth resistor R2*b* connected between ground and the negative input end of the amplifier 112, the diode Q1 with collector and base connected to ground and emitter connected to the drain of the transistor M1 through the third resistor R3, and the diode Q2 with collector and base connected to ground and emitter connected to the drain of the transistor M2. Finally, the circuit 202 comprises the transistor M3 having the source connected to the voltage $V_{DD}$, the gate connected to the output end of the amplifier 112, and the drain connected to the first node n1. In the p-channel bandgap reference unit 202, as in the unit 102, the transistors M1, M2, M3 and diodes Q1, Q2 are PNP.

The n-channel bandgap reference unit 204 is similar to an n-channel version of the bandgap reference circuit 30 of FIG. 3. The n-channel bandgap reference unit 204 includes the operational amplifier 114; the transistor M1 having the source connected to ground, the drain connected to the positive input end through an eleventh resistor R1*a*, and the gate connected to the output end of the amplifier 114; the transistor M2 having the source connected to ground, a drain connected to the negative input end of the amplifier 114 through a twelfth resistor R2*a*, and a gate connected to the output end of the amplifier 114; a thirteenth resistor R1*b* connected between the voltage $V_{DD}$ and the positive input end of the amplifier 114; and a fourteenth resistor R2*b* connected between the voltage $V_{DD}$ and the negative input end of the amplifier 114. The circuit 204 further comprises the diode Q1 with collector and base connected to the voltage $V_{DD}$ and emitter connected to the drain of the transistor M1 through the resistor R3, and the diode Q2 with collector and base connected to the voltage $V_{DD}$ and emitter connected to the drain of the transistor M2. Finally the circuit includes the transistor M3 having the source connected to ground, the gate connected to the output end of the amplifier 114, and the drain connected to the second node n2. In the n-channel bandgap reference unit 204, as in the unit 104, the transistors M1, M2, M3 and diodes Q1, Q2 are NPN.

For the third embodiment bandgap reference circuit 200, the minimum supply voltage, $V_{DD(min)}$, is given by:

$$V_{DD(\min)} = \mathrm{Max}\left[\begin{array}{l}\left(\frac{R_{1b}}{R_{1a}+R_{1b}}V_{\mathrm{EB2_PNP}} + |V_{TP}| + 2\cdot|V_{DSsat}|\right),\\ \left(\frac{R'_{1b}}{R'_{1a}+R'_{1b}}V_{\mathrm{BE2_NPN}} + V_{TN} + 2V_{DSsat}\right)\end{array}\right] \quad (15)$$

where:

$R_{1a}$, $R_{1b}$, $R_{1a}$, and $R_{1b}$ are the resistances of the resistors R1*a*, R1*b*, R1*a*, and R1*b*, respectively.

Operation and results of the first, second, and third embodiment circuits 70, 100, 200 are similar. In the third embodiment, equation (13) still applies, however, the value of $R_1$ is really $R_{1a}+R_{1b}=R_{1a}+_{1b}$. Generally, the second embodiment circuit 100 is more accurate requiring a supply voltage $V_{DD}$=1.5 V, while third embodiment circuit 200 is less accurate but only requires the supply voltage $V_{DD}$=0.9 V.

Figure 12:
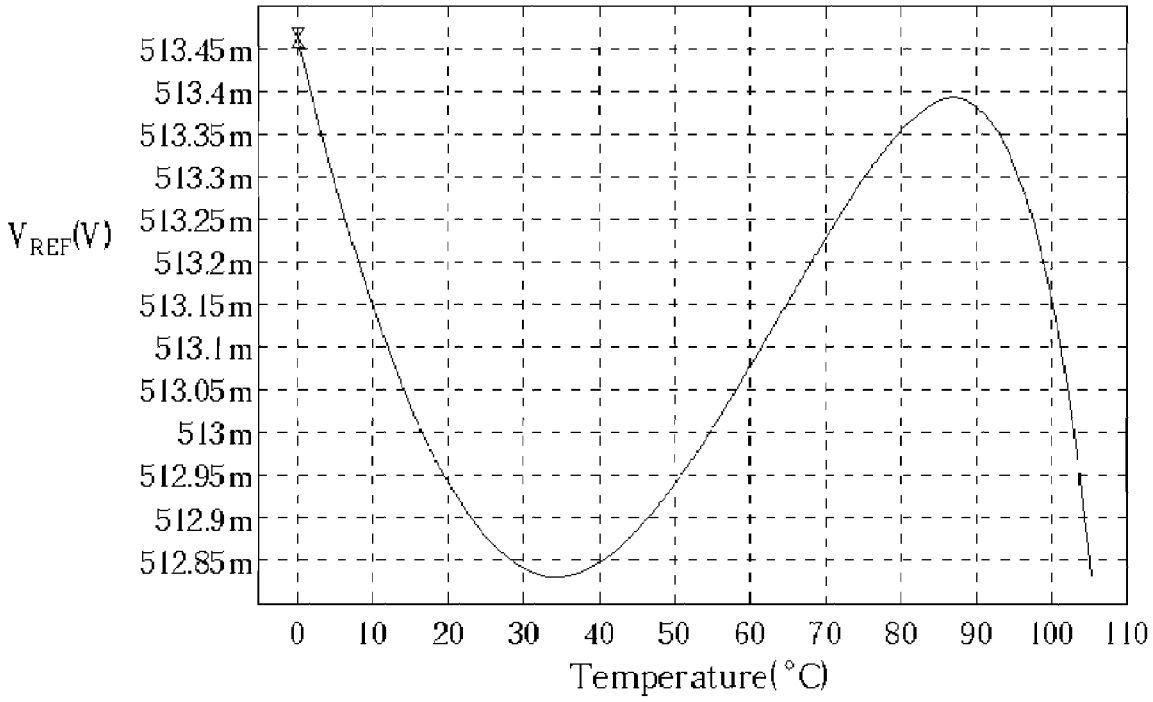
FIG. 12 is a graph of reference voltage versus temperature for the bandgap reference of FIG. 11.
Figure 13:
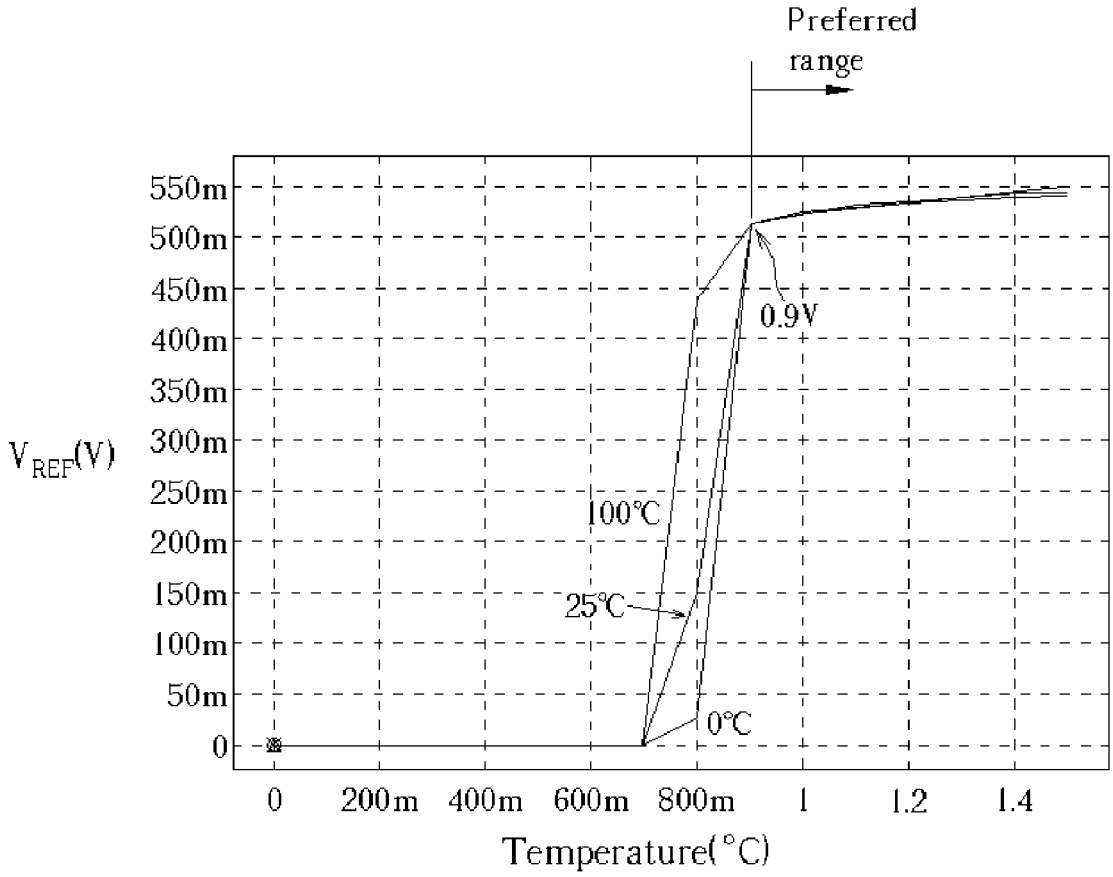
FIG. 13 is a graph of minimum supply voltage for the bandgap reference of FIG. 11.

FIG. 12 is a graph of reference voltage versus temperature, and FIG. 13 is a graph of minimum supply voltage for the third embodiment bandgap reference circuit 200 of FIG. 11. FIG. 12 and FIG. 13 plot results of a simulation of the circuit 200 which specified TSMC 0.25 $\mu$m technology. FIG. 12 shows a 10.7 ppm/° C. bandgap voltage reference from −10 to 120° C. FIG. 13 shows the minimum supply voltage of 0.9 V.

While the bandgap reference circuits 70, 100, and 200 were previously described as CMOS circuits, there is no reason why they cannot be implemented with other technologies such as with discrete components, BiCMOS, or emerging semiconductor processes. Furthermore, suitable combinations, where a mix of component types are used, of current or new technologies can also be used to realize the present invention.

In contrast to the prior art, the present invention provides a curvature-compensated low-voltage bandgap reference having a temperature insensitive reference voltage of less than 1 volt at the third node. Such a circuit can be readily manufactured with established CMOS method, and no low-threshold voltage or BiCMOS devices are required.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A bandgap reference circuit comprising:

a first bandgap reference unit having an output connected to a first node (n1);

a second bandgap reference unit having an output connected to a second node (n2); and a subtractor comprising:

a first transistor (M4) having a source connected to a first voltage, and a drain and a gate both connected to the second node (n2);

a second transistor (M5) having a source connected to the first voltage, a drain connected to a third node (n3), and a gate connected to the gate of the first transistor (M4);

a third transistor (M6) having a source connected to a second voltage, and a drain and a gate both connected to the first node (n1);

a fourth transistor (M7) having a source connected to the second voltage, a drain connected to the third node (n3), and a gate connected to the gate of the third transistor (M6); and an output resistor (RREF) connected between the third node (n3) and the second voltage.

2. The bandgap reference circuit of claim 1 wherein the first and second transistors (M4, M5) are PNP, the third and fourth transistors (M6, M7) are NPN, the second voltage is ground, and the first voltage is substantially higher than ground.

3. The bandgap reference circuit of claim 2 wherein the first bandgap reference unit is a CMOS p-channel bandgap reference, and the second bandgap reference unit is a CMOS n-channel bandgap reference.

4. The bandgap reference circuit of claim 3 wherein the first and second bandgap reference units produce output reference voltages of under 1 volt at the first and second nodes (n1, n2) respectively.

5. The bandgap reference circuit of claim 1 wherein the first voltage is approximately 0.9 volts relative to the second voltage being ground such that an output reference voltage at the third node (n3) is between 550 and 570 millivolts.

6. The bandgap reference circuit of claim 1 wherein the first bandgap reference unit comprises:

a first operational amplifier (112) having positive and negative input ends and an output end;

a fifth transistor (M1) having a source connected to the first voltage, a drain connected to the positive input end, and a gate connected to the output end;

a sixth transistor (M2) having a source connected to the first voltage, a drain connected to the negative input end, and a gate connected to the output end;

a first resistor (R1) connected between the second voltage and the positive input end;

a second resistor (R2) connected between the second voltage and the negative input end;

a first diode (Q1) having a collector and base connected to the second voltage, and an emitter connected to the positive input end through a third resistor (R3);

a second diode (Q2) having a collector and base connected to the second voltage, and an emitter connected to the positive input end; and a seventh transistor (M3) having a source connected to the first voltage, a gate connected to the output end, and a drain connected to the first node (n1).

7. The bandgap reference circuit of claim 6 wherein the second voltage is ground and the first voltage is substantially higher than ground; the third and fourth transistors (M6, M7) are NPN; the fifth, sixth, and seventh transistors (M1, M2, M3) are PNP; and the first and second diodes (Q1, Q2) are PNP.

8. The bandgap reference circuit of claim 1 wherein the second bandgap reference unit comprises:

a second operational amplifier (114) having positive and negative input ends and an output end;

an eighth transistor (M1) having a source connected to the second voltage, a drain connected to the positive input end, and a gate connected to the output end;

a ninth transistor (M2) having a source connected to the second voltage, a drain connected to the negative input end, and a gate connected to the output end;

a fourth resistor (R1) connected between the first voltage and the positive input end;

a fifth resistor (R2) connected between the first voltage and the negative input end;

a third diode (Q1) having a collector and base connected to the first voltage, and an emitter connected to the positive input end through a sixth resistor (R3);

a fourth diode (Q2) having a collector and base connected to the first voltage, and an emitter connected to the positive input end; and a tenth transistor (M3) having a source connected to the second voltage, a gate connected to the output end, and a drain connected to the second node (n2).

9. The bandgap reference circuit of claim 8 wherein the second voltage is ground and the first voltage is substantially higher than ground; the first and second transistors (M4, M5) are PNP; the eighth, ninth, and tenth transistors (M1, M2, M3) are NPN; and the second and third diodes (Q1, Q2) are NPN.

10. The bandgap reference circuit of claim 1 wherein the first bandgap reference unit comprises:

a first operational amplifier (112) having positive and negative input ends and an output end;

a fifth transistor (M1) having a source connected to the first voltage, a drain connected to the positive input end through a seventh resistor (R1*a*), and a gate connected to the output end;

a sixth transistor (M2) having a source connected to the first voltage, a drain connected to the negative input end through an eighth resistor (R2*a*), and a gate connected to the output end;

a ninth resistor (R1*b*) connected between the second voltage and the positive input end;

a tenth resistor (R2*b*) connected between the second voltage and the negative input end;

a first diode (Q1) having a collector and base connected to the second voltage, and an emitter connected to the drain of the fifth transistor (M1) through a third resistor (R3);

a second diode (Q2) having a collector and base connected to the second voltage, and an emitter connected to the drain of the sixth transistor (M2); and a seventh transistor (M3) having a source connected to the first voltage, a gate connected to the output end, and a drain connected to the first node (n1).

11. The bandgap reference circuit of claim 10 wherein the second voltage is ground and the first voltage is substantially higher than ground; the third and fourth transistors (M6, M7) are NPN; the fifth, sixth, and seventh transistors (M1, M2, M3) are PNP; and the first and second diodes (Q1, Q2) are PNP.

12. The bandgap reference circuit of claim 1 wherein the second bandgap reference unit comprises:

a second operational amplifier (114) having positive and negative input ends and an output end;

an eighth transistor (M1) having a source connected to the second voltage, a drain connected to the positive input end through an eleventh resistor (R1*a*), and a gate connected to the output end;

a ninth transistor (M2) having a source connected to the second voltage, a drain connected to the negative input end through a twelfth resistor (R2*a*), and a gate connected to the output end;

a thirteenth resistor (R1*b*) connected between the first voltage and the positive input end;

a fourteenth resistor (R2*b*) connected between the first voltage and the negative input end;

a third diode (Q1) having a collector and base connected to the first voltage, and an emitter connected to the drain of the eighth transistor (M1) through a sixth resistor (R3);

a fourth diode (Q2) having a collector and base connected to the first voltage, and an emitter connected to the drain of the ninth transistor (M2); and a tenth transistor (M3) having a source connected to the second voltage, a gate connected to the output end, and a drain connected to the second node (n2).

13. The bandgap reference circuit of claim 12 wherein the second voltage is ground and the first voltage is substantially higher than ground; the first and second transistors (M4, M5) are PNP; the eighth, ninth, and tenth transistors (M1, M2, M3) are NPN; and the second and third diodes (Q1, Q2) are NPN.

14. A bandgap reference circuit comprising:

a CMOS p-channel circuit for providing a first reference voltage to a first node (n1);

a CMOS n-channel circuit for providing a second reference voltage to a second node (n2); and a subtractor comprising:

a first transistor (M4) having a source connected to a first voltage, and a drain and a gate both connected to the second node (n2);

a second transistor (M5) having a source connected to the first voltage, a drain connected to a third node (n3), and a gate connected to the gate of the first transistor (M4);

a third transistor (M6) having a source connected to a second voltage, and a drain and a gate both connected to the first node (n1);

a fourth transistor (M7) having a source connected to the second voltage, a drain connected to the third node (n3), and a gate connected to the gate of the third transistor (M6); and an output resistor (RREF) connected between the third node (n3) and the second voltage.

15. The bandgap reference circuit of claim 14 wherein the first and second transistors (M4, M5) are PNP, the third and fourth transistors (M6, M7) are NPN, the second voltage is ground, and the first voltage is substantially higher than ground.

16. The bandgap reference circuit of claim 15 wherein the CMOS p-channel and n-channel circuits produce output reference voltages of under 1 volt at the first and second nodes (n1, n2) respectively.

17. The bandgap reference circuit of claim 14 wherein the first voltage is approximately 0.9 volts relative to the second voltage being ground such that an output reference voltage at the third node (n3) is between 550 and 570 millivolts.

* * * * *